United States Patent [19]

Miura et al.

[11] Patent Number: 4,849,726

[45] Date of Patent: Jul. 18, 1989

[54] CIRCUIT BREAKER

[75] Inventors: Masao Miura; Isamu Osima, both of Kanagawa, Japan

[73] Assignee: Fuji Electric Co., Ltd., Kanagawa, Japan

[21] Appl. No.: 205,947

[22] Filed: Jun. 13, 1988

[30] Foreign Application Priority Data

Jun. 24, 1987 [JP] Japan ..... 62-157409

[51] Int. Cl.[4] ..... H01H 77/10

[52] U.S. Cl. ..... 335/195; 335/190

[58] Field of Search ..... 335/195, 16, 147, 190; 200/147 R, 153 G, 153 H

[56] References Cited

U.S. PATENT DOCUMENTS 3,248,497 4/1966 Lindsay ..... 335/190

3,768,052 10/1973 Bühler et al. ..... 335/190

*Primary Examiner*—H. Broome

*Attorney, Agent, or Firm*—Finnegan, Henderson, Farabow, Garrett, & Dunner

[57] ABSTRACT

A circuit breaker of a current-limiting type, which is able to open quickly by using a magnetic repulsive force generated when currents of opposite direction flow through a fixed contactor and a movable contactor which are arranged in parallel to each other. The movable contactor opens or rotates around a supporting shaft. Then, a guide pin, secured at the base portion of the movable contactor, slides into a guiding longish opening and passes over a turning point formed in the longish opening. As a result, the line of action of a compressed spring force changes its direction in order to push up the movable contactor to the full open position.

4 Claims, 4 Drawing Sheets

CIRCUIT BREAKER

BACKGROUND OF THE INVENTION

I. Field of the Invention

The present invention relates to a circuit breaker, and more particularly to a circuit breaker of a current-limiting type, which can open quickly by using the magnetic repulsive forces generated due to the flow of currents in opposite directions through a fixed contactor and a movable contactor arranged in parallel with the fixed contactor.

II. Description of the Related Art

A conventional circuit breaker is shown in FIG. 6, which illustrates a longitudinal sectional view of an important part of the circuit breaker, and in FIG. 7, which illustrates an enlarged sectional view of the important part.

As shown in the drawings, a fixed contactor 2 is formed in a bent or U-shape and has a fixed contact point 1 secured on an end portion of an upper leg of the U-shaped contactor 2. A movable contactor 6 has a movable contact point 3, adapted with and separated from the fixed contact point 1, which is secured on an end portion of the movable contactor 6. The movable contactor 6 has a portion which is placed in parallel with the fixed contactor 2 when the circuit breaker is closed. A first supporting shaft 4 passes through an intermediate portion of the movable contactor 6 and is secured to a holder 10. A guide pin 5 passes through another end portion of the movable contactor 6 and is fixed to the end portion.

The movable contactor 6 is also oscillatably mounted on a holder 10 through the first supporting shaft 4 and a second supporting shaft 8, which is inserted through a movable contactor guide 7 for supporting one end portion of the movable contactor 6. The holder 10 is made of synthetic plastic material and has a rotary shaft 9 integrally formed on the holder 10. The movable contactor guide 7 is formed in a shape of a U and has a pair of longish openings *7a* provided in both legs of the movable contactor guide 7 so as to slidably guide the guide pin 5.

A contact spring 11 is resiliently installed between a bottom surface of the movable contactor guide 7 and the holder 10 in order to exert a force perpendicular to the longish openings *7a* as shown by an arrow in FIG. 7. This force gives a contact pressure on the movable contactor 6 by a counterclockwise moment around the first supporting shaft 4 when the movable contactor 6 is kept in contact with the fixed contactor 2 and when these contactors are closed. When the circuit breaker is shortcircuited, large opposing currents flowing through the parallel portions of the contactors 2 and 6 generate a magnetic repulsive force F (See FIG. 1), which clockwise rotates the movable contactor 6. Consequently, the guide pin 5 is shifted to the position as shown by the broken lines in FIG. 7. As a result, the point of application is shifted to this position and the force shown by an arrow with broken line produces clockwise moment around the supporting shaft 4 through the guide pin 5. This clockwise moment accelerates a quick opening of the circuit breaker.

In the conventional circuit breaker mentioned above, it is necessary to shift the point of application and reverse the direction of the moment while the fixed contactor 2 and the movable contactor 6 are within the opening distance of the circuit breaker in which the magnetic repulsive force generated between the two contactors is greater than the contact pressure. As a result, the rotational angle necessary to reverse the direction of the moment or the length for shifting the point of application is restricted when the circuit breaker opens in a current-limiting manner. This makes the length L1 of a perpendicular dropped from the center of the first supporting shaft 4 to the line of actions short and necessitating a strong force from the contact spring 11. As a consequence, a conventional circuit breaker requires the generated magnetic repulsive force to be larger than the strong contact pressure of the contact spring and to be continued until the guide pin 5 is shifted to the position where the direction of the moment is reversed, thereby making the current value for starting a current-limiting action large and making it difficult to manufacture a small-sized circuit breaker with a good current-limiting characteristic.

SUMMARY OF THE INVENTION

The object of the present invention is to provide an improved circuit breaker, which can be constructed to be of a small size, and which solves the problem of the conventional circuit breaker without making the functional forces of the contact spring larger.

Additional objects and advantages of the invention will be set forth in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the circuit breaker of this invention comprises a fixed contactor having a fixed contact point; a movable contactor, having a movable contact point on an end portion of the movable contactor and a portion confronting with the fixed contactor when the circuit breaker is closed, the movable contact point being arranged so as to contact with and separate from the fixed contact point of the fixed contactor, the movable contactor being arranged in parallel with the fixed contactor; a first supporting shaft provided in the confronting portion of the movable contactor; a guide pin provided on another end portion of the movable contactor; guide means on the movable contactor, provided with a turning point on a leg portion, for slidably guiding the guide pin; holder means for oscillatably supporting the guide means and the movable contactor; and a contact spring resiliently arranged between the holder means and the guide means, acting to exert contact pressure on the fixed contactor and the movable contactor when the fixed contactor and the movable contactor are both closed, the contact spring using a magnetic repulsive force generated when currents flow through the fixed contactor and the movable contactor in opposite directions and enabling the movable contactor to open and rotate around the first supporting shaft and the guide pin to slide along the guide means and to pass over the turning point.

In more detail, the circuit breaker according to the present invention has the movable contactor guide for guiding the guide pin of the movable contactor around a turning point. When the guide pin slides along the guide portion and passes over the turning point, the line of action of the contact spring force is changes its direction from a first condition at which the force exerts a contact pressure on the movable contractor to a second condition at which the force rotates the movable contactor to an open position and opens the circuit breaker. The length of the perpendicular dropped from the center of the first supporting shift to the line of action in the first condition is extended in the present invention thereby lessening the contact spring force and improving the current-limiting function of a small-sized circuit breaker.

DETAILED DESCRIPTION OF THE PREFERRED EMBODIMENTS

Figure 1:
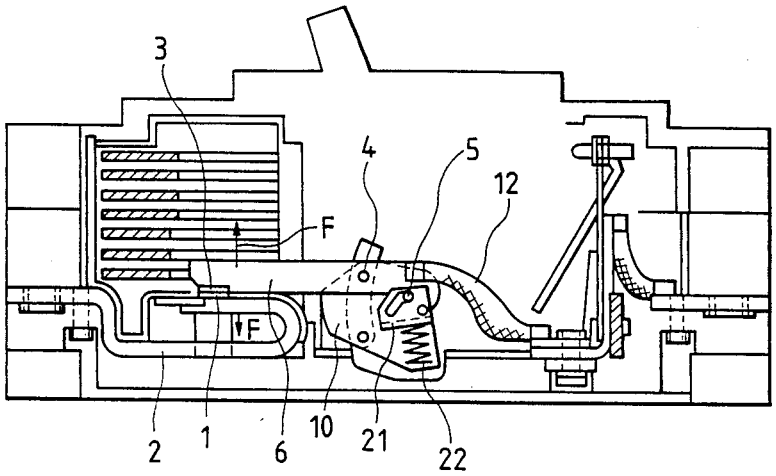
FIG. 1 is a longitudinal sectional view of an important portion of a circuit breaker constructed in accordance with a first embodiment of the present invention when the circuit breaker is closed.

Reference will now be made in detail to the present preferred embodiments of the invention, an example of which is illustrated in the accompanying drawings in which like reference characters refer to corresponding elements.

Figure 2:
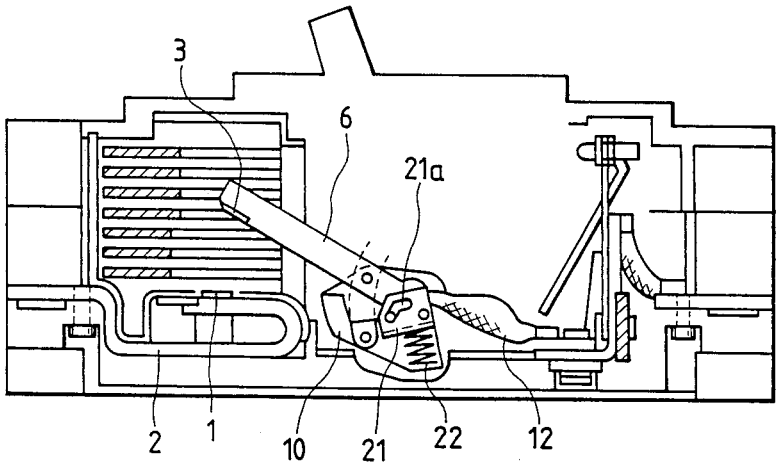
FIG. 2 is a longitudinal sectional view of the circuit breaker of FIG. 1 when the circuit breaker is open.
Figure 3:
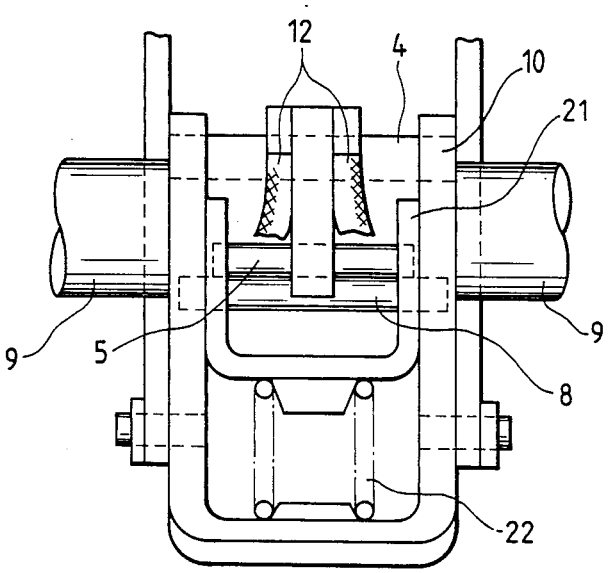
FIG. 3 is an enlarged frontal view of the circuit breaker of FIG. 1 when it is closed.
Figure 4:
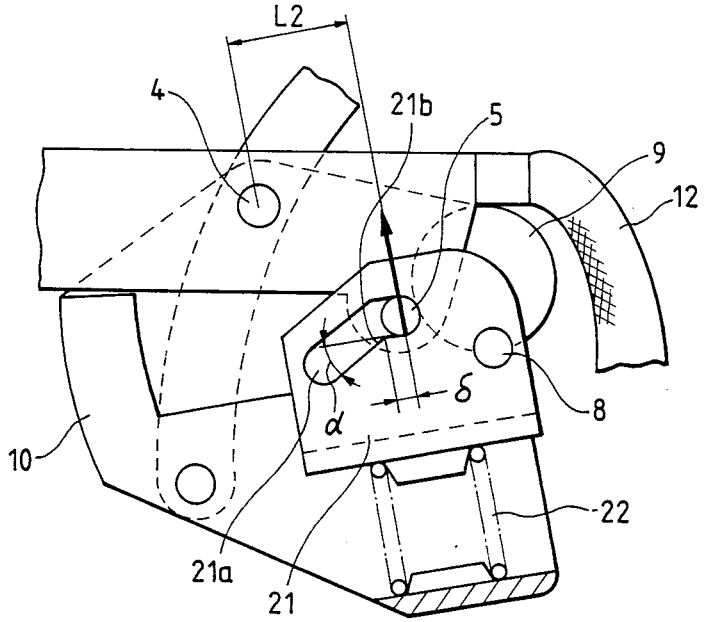
FIG. 4 is a longitudinal sectional view of the circuit breaker of FIG. 3.
Figure 5:
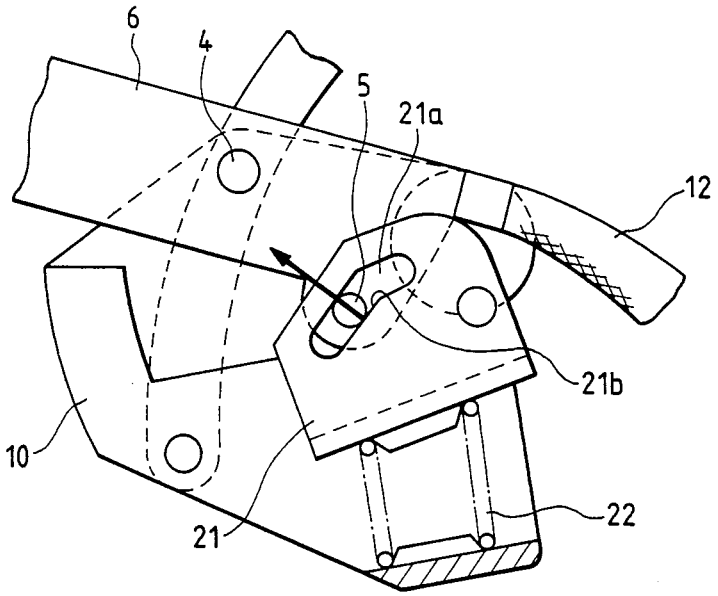
FIG. 5 is an enlarged sectional view of the circuit breaker of FIG. 4 when the circuit breaker is open.
Figure 6:
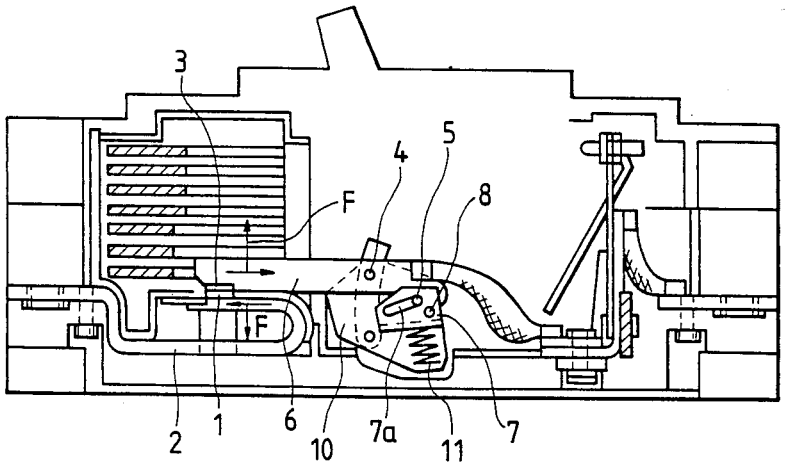
FIG. 6 PRIOR ART
FIG. 6 is a longitudinal sectional view of an important portion of a conventional circuit breaker when it is closed.
Figure 7:
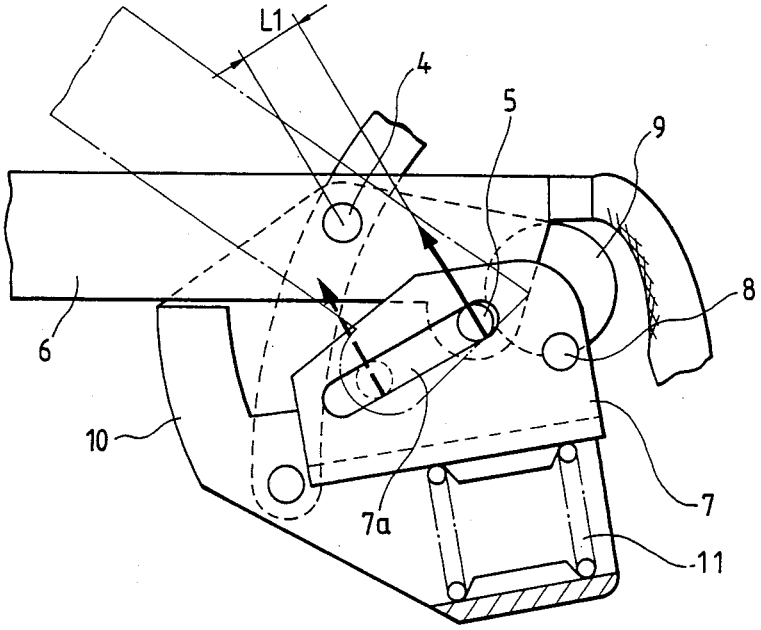
FIG. 7 PRIOR ART
FIG. 7 is an enlarged longitudinal sectional view of the conventional circuit breaker when it is open.

As shown in FIGS. 1 and 2, a guide portion or an longish opening 21*a* is formed on a movable contactor guide 21 which is arranged on a guide pin 5 of a movable contactor 6 and a holder 10. Longish opening 21*a* has a turning point 21*b* (shown in FIG. 4), so that a contact spring 22 exerts a force in different direction from that in the prior art when the guide pin 5 is on the right side of the turning point 216. Therefore longer length L2 can be given to a perpendicular dropped from the center of a first supporting shaft 4. As a result, the spring force of a contact spring 22 can be reduced for providing a necessary contact pressure making it possible to improve the current-limiting characteristic of a small circuit breaker and to lower the manufacturing cost of the circuit breaker.

In the construction of the improved circuit breaker according to the present invention, when a large current, such as is present during short-circuit of the circuit breaker, flows through a fixed contactor 2, a movable contactor 6, and a flexible conductor 12, a movable contact point 3, secured to the movable contactor 6, is raised from the fixed contact point 1 due to a magnetic repulsive force F generated between the fixed contactor 2 and the movable contactor 6. This also causes the movable contactor 6 to rotate clockwise around the first supporting shaft 4. Eventually the guide pin 5 slides to leftward in the longish opening 21*a*, formed on the movable contactor guide 21. Since the longish opening 21*a* is so designed as to have a short hooked distance δ (See FIG. 4) on the right side of the turning point 21*b* then the guide pin 5 soon passes over the curving point 21*b*.

A force of the contact spring 22 exerts clockwise moment to the movable contactor guide 21, after changing its direction of action on the left side of the turning point 21*b*, functioning to the open the movable contactor 6, as shown in FIG. 2 soon after the guide pin 5 passes over the turning point 21*b*. It is possible to form a stopper (not shown), that is situated so as to collide with the guide pin 5 of the movable contactor 6 when the circuit breaker is opened by a contactor operating mechanism (not shown) in order to return the movable contactor guide 21 to its original position.

The value of the operative current necessary to repulse the movable contactor 6 and to open the circuit breaker in a current-limiting manner can be determined by selecting the effective force of the contact spring 22. The opening angle necessary to start the opening action of the movable contactor 6 can be determined by determining a hooked distance δ and/or the turning angle α of the longish opening 21*a* (see FIG. 4).

In another embodiment of the circuit breaker of the present invention, the longish opening 21*a* of the movable contactor guide 21 can be made in another shape so as to have a turning point 21*b*.

Figure 8:
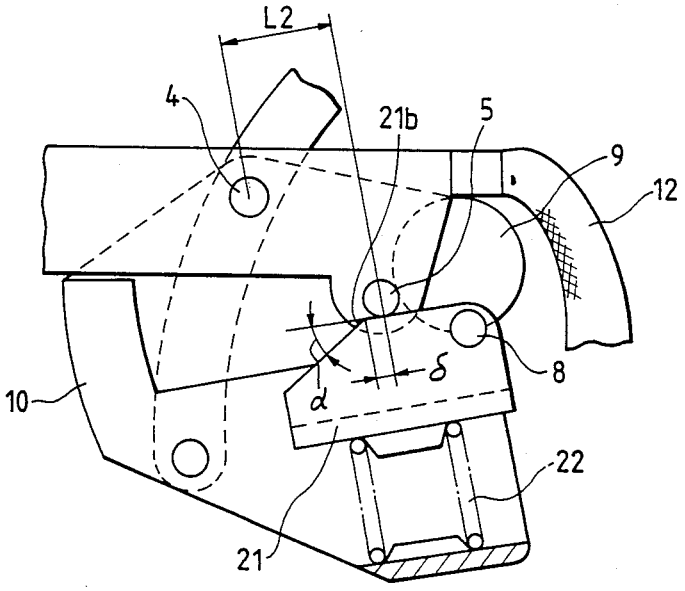
FIG. 8 is a longitudinal sectional view of an important portion of a circuit breaker constructed in accordance with a second embodiment of the present invention.

As shown in FIG. 8, the profile of the upper surface of the guide portion 21 is substantially identical with that of the former longish opening 21*a* and has a turning point 21*b*. In this case, the guide pin 5 slides along the upper surface of the guide portion 21 and passes over the turning point 21*b* achieving the same results as that of the first embodiment having the longish opening 21*a*.

It will be apparent to those skilled in the art that various modifications and variations can be made in the circuit breaker of the present invention without departing from the scope or spirit of the invention. Thus, it is intended that the present invention cover the modifications and variations of this invention provided they come within the scope of the appended claims and their equivalents.

What is claimed is:

1. A circuit breaker comprising:

a fixed contactor, having a fixed contact point;

a movable contactor, having a movable contact point on an end portion of said movable contactor and a portion confronting with said fixed contactor when said circuit breaker is closed, said movable contact point being arranged so as to contact with and separate from said fixed contact point of said fixed contactor, said movable contactor being arranged in parallel with said fixed contactor;

a first supporting pin provided in said confronting portion of said movable contactor;

a guide pin provided on another end portion of said movable contactor;

guide means surrounding said guide pin provided with a turning point for slidably guiding the guide pin;

holder means for oscillatably supporting the guide means and the movable contactor; and a contact spring resiliently arranged between the holder means and the guide means, acting to exert contact pressure on said fixed contactor and said movable contactor when said fixed contactor and said movable contactor are both closed, when currents of opposite direction flow through said fixed contactor and said movable contactor overcomes the contact pressure exerted by said contact spring, said contact spring thus acts to exert a force enabling said movable contactor to open and rotate around said first supporting shaft and said guide pin to slide along said guide means and to pass over said turning point.

2. The circuit breaker according to claim 1, in which said guide means is a bent, elongated opening.

3. The circuit breaker according to claim 1, in which said guide means is a bent surface formed on said movable contactor guide.

4. The circuit breaker according to claim 1, in which said fixed contactor is formed in a U-shape.

* * * * *